US007341502B2

(12) United States Patent
Elledge

(10) Patent No.: US 7,341,502 B2
(45) Date of Patent: Mar. 11, 2008

(54) METHODS AND SYSTEMS FOR PLANARIZING WORKPIECES, E.G., MICROELECTRONIC WORKPIECES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 217 days.

(21) Appl. No.: 10/199,734

(22) Filed: Jul. 18, 2002

(65) Prior Publication Data

US 2004/0014396 A1 Jan. 22, 2004

(51) Int. Cl.
*B24B 19/00* (2006.01)

(52) U.S. Cl. ..... 451/6; 451/7; 451/10; 451/11; 451/287; 438/692; 156/345.13; 156/345.15; 156/345.27; 216/85

(58) Field of Classification Search ..... 451/5, 451/6, 7, 10, 11, 41, 53, 285, 287, 526, 533; 438/692, 693; 156/345.12, 345.13, 345.15, 156/345.24, 345.27; 216/85
See application file for complete search history.

(56) References Cited

U.S. PATENT DOCUMENTS

| | | | |
|---|---|---|---|
| 4,145,703 | A | 3/1979 | Blanchard et al. |
| 4,200,395 | A | 4/1980 | Smith et al. |
| 4,203,799 | A | 5/1980 | Sugawara et al. |
| 4,305,760 | A | 12/1981 | Trudel |
| 4,358,338 | A | 11/1982 | Downey et al. |
| 4,367,044 | A | 1/1983 | Booth, Jr. et al. |
| 4,377,028 | A | 3/1983 | Imahashi |
| 4,422,764 | A | 12/1983 | Eastman |
| 4,498,345 | A | 2/1985 | Dyer et al. |
| 4,501,258 | A | 2/1985 | Dyer et al. |
| 4,502,459 | A | 3/1985 | Dyer |

(Continued)

FOREIGN PATENT DOCUMENTS

EP 0 623 423 A1 11/1994

(Continued)

OTHER PUBLICATIONS

Banaszak, D. et al., "Visual Crack Measurement System Uses Temperature-Sensitive Paint," Reference document VA-00-01, 5 pages, http://www.arfrlhorizons.com/Briefs/0012/VA0001.html (accessed Apr. 17, 2002), Associated Business Publications International, New York, New York.

(Continued)

*Primary Examiner*—Eileen P. Morgan
(74) *Attorney, Agent, or Firm*—Perkins Coie LLP

(57) ABSTRACT

Planarizing workpieces, e.g., microelectronic workpieces, can employ a process indicator which is adapted to change an optical property in response to a planarizing condition. This process indicator may, for example, change color in response to reaching a particular temperature or in response to a particular shear force. In this example, the change in color of the process indicator may be correlated with an ongoing operating condition of the planarizing machine, such as excessive downforce, or correlated with an endpoint of the planarizing operation. Incorporating the process indicator in the planarizing medium, as proposed for select applications, can enable relatively simple, real-time collection of information which can be used to control a planarizing operation.

34 Claims, 6 Drawing Sheets

U.S. PATENT DOCUMENTS

| | | | | |
|---|---|---|---|---|
| 4,640,002 | A | 2/1987 | Phillips et al. | |
| 4,660,980 | A | 4/1987 | Takabayashi et al. | |
| 4,717,255 | A | 1/1988 | Ulbers | |
| 4,755,058 | A | 7/1988 | Shaffer | |
| 4,879,258 | A | 11/1989 | Fisher | |
| 4,946,550 | A | 8/1990 | Van Laarhoven | |
| 4,971,021 | A | 11/1990 | Kubotera et al. | |
| 5,020,283 | A | 6/1991 | Tuttle | |
| 5,036,015 | A | 7/1991 | Sandhu et al. | |
| 5,069,002 | A | 12/1991 | Sandhu et al. | 51/165 R |
| 5,081,796 | A | 1/1992 | Schultz | 51/165.74 |
| 5,163,334 | A | 11/1992 | Li et al. | |
| 5,196,353 | A | 3/1993 | Sandhu et al. | |
| 5,220,405 | A | 6/1993 | Barbee et al. | |
| 5,222,329 | A | 6/1993 | Yu | |
| 5,232,875 | A | 8/1993 | Tuttle et al. | 437/225 |
| 5,234,867 | A | 8/1993 | Schultz et al. | 438/225 |
| 5,240,552 | A | 8/1993 | Yu et al. | 156/636 |
| 5,244,534 | A | 9/1993 | Yu et al. | 156/636 |
| 5,245,790 | A | 9/1993 | Jerbic | 51/121 |
| 5,245,796 | A | 9/1993 | Miller et al. | 51/283 R |
| RE34,425 | E | 11/1993 | Schultz | 51/165.74 |
| 5,314,843 | A | 5/1994 | Yu et al. | |
| 5,324,381 | A | 6/1994 | Nishiguchi | |
| 5,369,488 | A | 11/1994 | Morokuma | |
| 5,393,624 | A | 2/1995 | Ushijima | |
| 5,413,941 | A | 5/1995 | Koos et al. | |
| 5,421,769 | A | 6/1995 | Schultz et al. | 451/287 |
| 5,433,649 | A | 7/1995 | Nishida | |
| 5,433,651 | A * | 7/1995 | Lustig et al. | 451/6 |
| 5,438,879 | A | 8/1995 | Reda | |
| 5,439,551 | A | 8/1995 | Meikle et al. | |
| 5,449,314 | A | 9/1995 | Meikle et al. | 451/41 |
| 5,461,007 | A | 10/1995 | Kobayashi | |
| 5,465,154 | A | 11/1995 | Levy | |
| 5,486,129 | A | 1/1996 | Sandhu et al. | 451/5 |
| 5,499,733 | A * | 3/1996 | Litvak | 216/38 |
| 5,514,245 | A | 5/1996 | Doan et al. | 156/636.1 |
| 5,533,924 | A | 7/1996 | Stroupe et al. | 451/286 |
| 5,540,810 | A | 7/1996 | Sandhu et al. | 156/636.1 |
| 5,573,442 | A | 11/1996 | Morita et al. | |
| 5,609,718 | A | 3/1997 | Meikle | |
| 5,616,069 | A | 4/1997 | Walker et al. | |
| 5,618,381 | A | 4/1997 | Doan et al. | 438/633 |
| 5,618,447 | A | 4/1997 | Sandhu | |
| 5,624,303 | A | 4/1997 | Robinson | |
| 5,632,666 | A | 5/1997 | Peratello et al. | |
| 5,643,044 | A | 7/1997 | Lund | |
| 5,643,048 | A | 7/1997 | Iyer | |
| 5,643,060 | A | 7/1997 | Sandhu et al. | 451/285 |
| 5,645,471 | A | 7/1997 | Strecker | |
| 5,645,682 | A | 7/1997 | Skrovan | |
| 5,650,619 | A | 7/1997 | Hudson | |
| 5,655,951 | A | 8/1997 | Meikle et al. | |
| 5,658,183 | A | 8/1997 | Sandhu et al. | 451/5 |
| 5,658,190 | A | 8/1997 | Wright et al. | 451/285 |
| 5,663,797 | A | 9/1997 | Sandhu | |
| 5,664,988 | A | 9/1997 | Stroupe et al. | 451/41 |
| 5,667,424 | A | 9/1997 | Pan | |
| 5,668,061 | A | 9/1997 | Herko et al. | |
| 5,679,065 | A | 10/1997 | Henderson | 451/290 |
| 5,681,204 | A | 10/1997 | Kawaguchi et al. | |
| 5,681,423 | A | 10/1997 | Sandhu et al. | |
| 5,690,540 | A | 11/1997 | Elliott et al. | |
| 5,698,455 | A | 12/1997 | Meikle et al. | |
| 5,700,180 | A | 12/1997 | Sandhu et al. | |
| 5,702,292 | A | 12/1997 | Brunelli et al. | 451/41 |
| 5,708,506 | A * | 1/1998 | Birang | 356/600 |
| 5,725,417 | A | 3/1998 | Robinson | |
| 5,730,642 | A | 3/1998 | Sandhu et al. | 451/6 |
| 5,736,427 | A | 4/1998 | Henderson | |
| 5,738,562 | A | 4/1998 | Doan et al. | |
| 5,738,567 | A | 4/1998 | Manzonie et al. | |
| 5,747,386 | A | 5/1998 | Moore | 438/692 |
| 5,777,739 | A | 7/1998 | Sandhu et al. | |
| 5,779,522 | A | 7/1998 | Walker et al. | |
| 5,782,675 | A | 7/1998 | Southwick | |
| 5,791,969 | A | 8/1998 | Lund | |
| 5,792,709 | A | 8/1998 | Robinson et al. | 438/692 |
| 5,795,218 | A | 8/1998 | Doan et al. | |
| 5,795,495 | A | 8/1998 | Meikle | 216/88 |
| 5,798,302 | A | 8/1998 | Hudson et al. | |
| 5,801,066 | A | 9/1998 | Meikle | 438/14 |
| 5,807,165 | A | 9/1998 | Uzoh et al. | 451/41 |
| 5,823,855 | A | 10/1998 | Robinson | |
| 5,830,806 | A | 11/1998 | Hudson et al. | 438/690 |
| 5,842,909 | A | 12/1998 | Sandhu et al. | |
| 5,846,336 | A | 12/1998 | Skrovan | |
| 5,851,135 | A | 12/1998 | Sandhu et al. | 451/5 |
| 5,855,804 | A | 1/1999 | Walker | |
| 5,865,665 | A | 2/1999 | Yueh | |
| 5,868,896 | A | 2/1999 | Robinson et al. | 156/344 |
| 5,871,392 | A | 2/1999 | Meikle et al. | |
| 5,879,222 | A | 3/1999 | Robinson | |
| 5,879,226 | A | 3/1999 | Robinson | |
| 5,882,244 | A * | 3/1999 | Hiyama et al. | 451/7 |
| 5,882,248 | A | 3/1999 | Wright et al. | 451/285 |
| 5,893,754 | A | 4/1999 | Robinson et al. | 438/692 |
| 5,893,796 | A | 4/1999 | Birang et al. | |
| 5,894,852 | A | 4/1999 | Gonzales et al. | |
| 5,895,550 | A | 4/1999 | Andreas | 156/345 |
| 5,899,792 | A | 5/1999 | Yagi | |
| 5,910,043 | A | 6/1999 | Manzonie et al. | |
| 5,910,846 | A | 6/1999 | Sandhu | |
| 5,930,699 | A | 7/1999 | Bhatia | |
| 5,934,973 | A | 8/1999 | Boucher et al. | |
| 5,934,974 | A | 8/1999 | Tzeng | |
| 5,934,980 | A | 8/1999 | Koos et al. | 451/41 |
| 5,936,733 | A | 8/1999 | Sandhu et al. | |
| 5,938,801 | A | 8/1999 | Robinson | |
| 5,945,347 | A | 8/1999 | Wright | 438/692 |
| 5,949,927 | A | 9/1999 | Tang | |
| 5,954,912 | A | 9/1999 | Moore | |
| 5,967,030 | A | 10/1999 | Blalock | 100/211 |
| 5,969,805 | A | 10/1999 | Johnson et al. | |
| 5,972,715 | A | 10/1999 | Celentano et al. | |
| 5,972,792 | A | 10/1999 | Hudson | 438/691 |
| 5,976,000 | A | 11/1999 | Hudson | |
| 5,980,363 | A | 11/1999 | Meikle et al. | 451/41 |
| 5,981,396 | A | 11/1999 | Robinson et al. | 438/692 |
| 5,989,470 | A | 11/1999 | Doan et al. | |
| 5,994,224 | A | 11/1999 | Sandhu et al. | 438/692 |
| 5,997,384 | A | 12/1999 | Blalock | 451/41 |
| 6,000,996 | A | 12/1999 | Fujiwara | |
| 6,006,739 | A | 12/1999 | Akram et al. | |
| 6,007,408 | A | 12/1999 | Sandhu | |
| 6,036,586 | A | 3/2000 | Ward | |
| 6,039,633 | A | 3/2000 | Chopra | 451/41 |
| 6,040,111 | A | 3/2000 | Karasawa et al. | |
| 6,040,245 | A | 3/2000 | Sandhu et al. | 438/692 |
| 6,045,439 | A | 4/2000 | Birang et al. | |
| 6,046,111 | A | 4/2000 | Robinson | |
| 6,054,015 | A | 4/2000 | Brunelli et al. | 156/345 |
| 6,057,602 | A | 5/2000 | Hudson et al. | |
| 6,066,030 | A | 5/2000 | Uzoh | 451/41 |
| 6,068,539 | A | 5/2000 | Bajaj et al. | |
| 6,074,286 | A | 6/2000 | Ball | 451/285 |
| 6,075,606 | A | 6/2000 | Doan | |
| 6,077,147 | A | 6/2000 | Yang et al. | |
| 6,083,085 | A | 7/2000 | Lankford | 451/56 |
| 6,102,775 | A | 8/2000 | Ushio et al. | |
| 6,104,448 | A | 8/2000 | Doan et al. | |
| 6,106,351 | A | 8/2000 | Raina et al. | |
| 6,106,662 | A | 8/2000 | Bibby, Jr. et al. | |

6,108,091 A 8/2000 Pecen et al.
6,108,092 A 8/2000 Sandhu
6,110,820 A 8/2000 Sandhu et al. ..... 438/633
6,114,706 A 9/2000 Meikle et al.
6,116,988 A 9/2000 Ball ..... 451/41
6,120,354 A 9/2000 Koos et al. ..... 451/41
6,124,207 A 9/2000 Robinson et al.
6,135,856 A 10/2000 Tjaden et al. ..... 451/37
6,139,402 A 10/2000 Moore ..... 451/41
6,143,123 A 11/2000 Robinson et al. ..... 156/344
6,143,155 A 11/2000 Adams et al. ..... 205/87
6,146,248 A 11/2000 Jairath et al.
6,152,803 A 11/2000 Boucher et al.
6,152,808 A 11/2000 Moore ..... 451/60
6,165,937 A 12/2000 Puckett et al.
6,176,992 B1 1/2001 Talieh
6,179,709 B1 1/2001 Redeker et al.
6,180,525 B1 1/2001 Morgan
6,184,571 B1 2/2001 Moore
6,186,870 B1 2/2001 Wright et al.
6,187,681 B1 2/2001 Moore ..... 438/691
6,190,234 B1 2/2001 Swedek et al.
6,190,494 B1 2/2001 Dow
6,191,037 B1 * 2/2001 Robinson et al. ..... 438/690
6,191,864 B1 2/2001 Sandhu
6,193,588 B1 2/2001 Carlson et al. ..... 451/66
6,200,901 B1 3/2001 Hudson et al. ..... 438/697
6,203,404 B1 3/2001 Joslyn et al. ..... 451/37
6,203,407 B1 3/2001 Robinson
6,203,413 B1 3/2001 Skrovan ..... 451/72
6,206,679 B1 3/2001 Walker
6,206,754 B1 3/2001 Moore
6,206,756 B1 3/2001 Chopra et al. ..... 451/28
6,206,759 B1 3/2001 Agarwal et al.
6,206,769 B1 3/2001 Walker
6,208,425 B1 3/2001 Sandhu et al.
6,210,257 B1 4/2001 Carlson ..... 451/56
6,213,845 B1 4/2001 Elledge ..... 451/6
6,218,316 B1 4/2001 Marsh ..... 438/780
6,224,466 B1 5/2001 Walker et al.
6,227,955 B1 5/2001 Custer et al. ..... 451/285
6,234,874 B1 5/2001 Ball ..... 451/41
6,234,877 B1 5/2001 Koos et al. ..... 451/41
6,234,878 B1 5/2001 Moore ..... 451/41
6,237,483 B1 5/2001 Blalock ..... 100/211
6,238,270 B1 5/2001 Robinson
6,238,273 B1 * 5/2001 Southwick ..... 451/41
6,241,593 B1 6/2001 Chen et al.
6,244,944 B1 6/2001 Elledge
6,247,998 B1 6/2001 Wiswesser et al.
6,250,994 B1 6/2001 Chopra et al. ..... 451/56
6,251,785 B1 6/2001 Wright ..... 438/692
6,254,459 B1 7/2001 Bajaj et al.
6,261,151 B1 7/2001 Sandhu et al. ..... 451/5
6,261,163 B1 7/2001 Walker et al. ..... 451/311
6,264,533 B1 7/2001 Kummeth et al.
6,267,650 B1 7/2001 Hembree ..... 451/49
6,271,139 B1 8/2001 Alwan et al.
6,273,101 B1 8/2001 Gonzales et al.
6,273,786 B1 8/2001 Chopra et al. ..... 451/28
6,273,796 B1 8/2001 Moore ..... 451/56
6,273,800 B1 8/2001 Walker et al.
6,276,996 B1 8/2001 Chopra ..... 451/41
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,012 B1 10/2001 Sabde ..... 451/41
6,306,014 B1 10/2001 Walker et al. ..... 451/41
6,306,768 B1 10/2001 Klein ..... 438/693
6,309,282 B1 10/2001 Wright et al.
6,312,558 B2 11/2001 Moore ..... 156/345
6,313,038 B1 11/2001 Chopra et al.
6,319,420 B1 11/2001 Dow
6,323,046 B1 11/2001 Agarwal
6,325,702 B2 12/2001 Robinson
6,328,632 B1 12/2001 Chopra ..... 451/41
6,331,135 B1 12/2001 Sabde et al.
6,331,139 B2 12/2001 Walker et al.
6,331,488 B1 12/2001 Doan et al. ..... 438/698
6,332,831 B1 12/2001 Shemo et al.
6,338,667 B2 1/2002 Sandhu et al.
6,350,180 B2 2/2002 Southwick ..... 451/41
6,350,691 B1 2/2002 Lankford ..... 438/692
6,352,466 B1 3/2002 Moore ..... 451/5
6,352,470 B2 3/2002 Elledge ..... 451/285
6,354,923 B1 3/2002 Lankford ..... 451/72
6,354,930 B1 3/2002 Moore ..... 451/527
6,358,122 B1 3/2002 Sabde et al. ..... 451/41
6,358,127 B1 3/2002 Carlson et al. ..... 451/67
6,358,129 B2 3/2002 Dow ..... 451/285
6,361,417 B2 3/2002 Walker et al. ..... 451/168
6,362,105 B1 3/2002 Moore
6,364,746 B2 4/2002 Moore
6,364,757 B2 4/2002 Moore ..... 451/530
6,368,190 B1 4/2002 Easter et al. ..... 451/41
6,368,193 B1 4/2002 Carlson et al. ..... 451/66
6,368,194 B1 4/2002 Sharples et al. ..... 451/67
6,368,197 B2 4/2002 Elledge ..... 451/296
6,376,381 B1 4/2002 Sabde ..... 438/693
6,383,934 B1 5/2002 Sabde et al.
6,387,289 B1 5/2002 Wright
6,395,130 B1 5/2002 Adams et al.
6,395,620 B1 5/2002 Pan et al.
6,402,884 B1 6/2002 Robinson et al.
6,425,801 B1 7/2002 Takeishi et al.
6,426,232 B1 7/2002 Litvak
6,428,386 B1 8/2002 Bartlett
6,447,369 B1 9/2002 Moore
6,498,101 B1 12/2002 Wang
6,511,576 B2 1/2003 Klein
6,520,834 B1 2/2003 Marshall
6,524,164 B1 2/2003 Tolles
6,533,893 B2 3/2003 Sabde et al.
6,537,133 B1 3/2003 Birang et al.
6,537,144 B1 3/2003 Tsai et al.
6,547,640 B2 4/2003 Hofmann
6,548,407 B1 4/2003 Chopra et al.
6,579,799 B2 6/2003 Chopra et al.
6,592,443 B1 7/2003 Kramer et al.
6,609,947 B1 8/2003 Moore
6,609,952 B1 * 8/2003 Simon ..... 451/6
6,612,901 B1 9/2003 Agarwal
6,621,584 B2 9/2003 Pecen et al.
6,623,329 B1 9/2003 Moore
6,628,410 B2 9/2003 Doan
6,629,874 B1 * 10/2003 Halley ..... 451/6
6,633,084 B1 10/2003 Sandhu et al.
6,652,764 B1 11/2003 Blalock
6,666,749 B2 12/2003 Taylor
6,813,824 B2 11/2004 Hasegawa et al.
6,876,454 B1 4/2005 Birang et al.
2001/0012539 A1 8/2001 Bernard et al.
2004/0012795 A1 1/2004 Moore
2004/0014396 A1 1/2004 Elledge
2004/0029490 A1 2/2004 Agarwal

FOREIGN PATENT DOCUMENTS

JP 2004363229 A 12/2004
WO WO 01/04221 A1 1/2001

WO WO 01/64430 A1 9/2001

OTHER PUBLICATIONS

Bencic, T.J., "Application of Pressure-Sensitive Paint to Ice-Accreted Wind Tunnel Models," NASA/TM-2000-209942, http://gltrs.grc.nasa.gov/GLTRS, 14 pages, National Aeronautics and Space Administration, John H. Glenn Research Center, Cleveland, Ohio, Jun. 2000, prepared for the 38th Aerospace Sciences Meeting and Exhibit sponsored by the American Institute of Aeronautics and Astronautics, Reno, Nevada, Jan. 10-14, 2000.

Carroll, B.F., "Fundamentals of Pressure and Temperature Sensitive Paints," http//:www.aero.ulf.edu/~bfc/html/body_fundamentals.htm (accessed Apr. 17, 2002), 2 pages, University of Florida, Department of Aerospace Engineering, Mechanics & Engineering Science, Gainsville, Florida.

Color Change Corporation, "Leuco Dyes," http://www.colorchange.com/tech-id.htm (accessed Nov. 26, 2001), 2 pages, Streamwood, Illinois.

Hallcrest, Inc., "Data Sheet Listing," http://www.hallcrest.com/industrial/industrial.pdf (accessed Nov. 26, 2001), 1 page, Glenview, Illinois.

Hallcrest, Inc., "Product Overview," http://www.hallcrest.com/industrial/industrial.pdf (accessed Nov. 26, 2001), 2 pages, Glenview, Illinois, Jun. 2000.

Hallcrest, Inc., "Technology Background: The Use of TLC Products As Research Tools," http://www.hallcrest.com/industrial/industrial.pdf (accessed Nov. 26, 2001), 2 pages, Glenview, Illinois, Jun. 2000.

Hallcrest, Inc., "Color Change Properties," http://www.hallcrest.com/industrial/industrial.pdf (accessed Nov. 26, 2001), 2 pages, Glenview, Illinois, Jun. 2000.

Hallcrest, Inc., "TLC Coated Polyester Sheets," http://www.hallcrest.com/industrial/industrial.pdf (accessed Nov. 26, 2001), 2 pages, Glenview, Illinois, Mar. 2000.

Hallcrest, Inc., "Introductory Liquid Crystal Kit KT500," http://www.hallcrest.com/industrial/industrial.pdf (accessed Nov. 26, 2001), 1 page, Glenview, Illinois, Jun. 2000.

Hallcrest, Inc., "Shear-Sensitive Cholesteric LC Mixtures," http://www.hallcrest.com/industrial/industrial.pdf (accessed Nov. 26, 2001), 2 pages, Glenview, Illinois, Jun. 2000.

Hallcrest, Inc., "Microencapsulated TLC Slurries," http://www.hallcrest.com/industrial/industrial.pdf (accessed Nov. 26, 2001), 2 pages, Glenview, Illinois, Jun. 2000.

Hallcrest, Inc., "Sprayable TLC Coatings," http://www.hallcrest.com/industrial/industrial.pdf (accessed Nov. 26, 2001), 2 pages, Glenview, Illinois, Jun. 2000.

Hallcrest, Inc., "Ancillary Products," http://www.hallcrest.com/industrial/industrial.pdf (accessed Nov. 26, 2001), 2 pages, Glenview, Illinois, Jun. 2000.

Hallcrest, Inc., "General Application Notes," http://www.hallcrest.com/industrial/industrial.pdf (accessed Nov. 26, 2001), 1 page, Glenview, Illinois, Jun. 2000.

Hallcrest, Inc., "Literature Review: TLC Applications (1) Engineering and Aerodynamic Research; Heat Transfer and Flow Visualization Studies," http://www.hallcrest.com/industrial/industrial.pdf (accessed Nov. 26, 2001), 5 pages, Glenview, Illinois, May 1991.

Hallcrest, Inc., "Literature Review: TLC Applications (3) General Thermal Mapping and Non-Destructive Testing (NDT)," http://www.hallcrest.com/industrial/industrial.pdf (accessed Nov. 26, 2001), 4 pages, Glenview, Illinois, Jan. 1996.

Hamner, M.P. et al., "Using Temperature Sensitive Paint Technology," AIAA 2002-0742, pp. 1-20, American Institute of Aeronautics and Astronautics, Inc., Reston, Virginia, presented at 40th Aerospace Sciences Meeting & Exhibit, Jan. 14-17, 2002, Reno, Nevada.

Homola, J., "Color-Changing Inks, Brighten your bottom line," http://www.screenweb.com/inks/cont/brighten981119.html (accessed Nov. 26, 2001), 5 pages, ST Media Group International, Cincinnati, Ohio.

Hubner, J.P. et al., "Heat Transfer Measurements In Hypersonic Flow Using Luminescent Coating Techniques," AIAA 2002-0741, pp. 1-11, American Institute of Aeronautics and Astronautics, Inc., Reston, Virginia, presented at 40th Aerospace Sciences Meeting & Exhibit, Jan. 14-17, 2002, Reno, Nevada.

International Ink Company LLC, "Temp-Tell® Thermochromic Inks," http://www.iicink.com/temptell.htm (accessed Nov. 26, 2001), 3 pages, Gainesville, Georgia.

Kondo, S. et al., "Abrasive-Free Polishing for Copper Damascene Interconnection", *Journal of the Electrochemical Society*, vol. 147, No. 10, pp. 3907-3913, The Electrochemical Society, Inc., Pennington, New Jersey, 2000.

Lakfabriek Korthals BV, "Therm-O-Signal Temperature indicating paints," http://www.korthals.nl/e/Product/TOse.html (accessed Apr. 17, 2002), 2 pages, The Netherlands.

Lepicovsky, J. et al., "Use of Pressure Sensitive Paint for Diagnostics In Turbomachinery Flows With Shocks," NASA/TM-2001-211111, ISABE 2001-1142, http://gltrs.grc.nasa.gov/GLTRS, pp. 1-9, National Aeronautics and Space Administration, John H. Glenn Research Center, Cleveland, Ohio, Nov. 2001, prepared for the 15th International Symposium on Airbreathing Engines, sponsored by the International Society for Airbreathing Engines, Bangalore, India, Sep. 2-7, 2001.

Photonics Net, "Paint Glows Under Pressure," http://www.photonics.com/Content/Aug98/techPaint.html (accessed Apr. 17, 2002), 4 pages, Laurin Publishing Co., Inc., Pittsfield, Massachusetts, Aug. 1998.

Applied Materials, Inc., "Mirra Mesa Advanced Integrated CMP," 2 pages, 2002, retrieved from the Internet, <http://www.appliedmaterials.com>.

Applied Materials, Inc., "About the CMP Process," 1 page, 2002, retrieved from the Internet, <http://www.appliedmaterials.com>.

* cited by examiner

METHODS AND SYSTEMS FOR PLANARIZING WORKPIECES, E.G., MICROELECTRONIC WORKPIECES

TECHNICAL FIELD

The present invention provides certain improvements in processing microelectronic workpieces. The invention has particular utility in connection with planarizing microelectronic workpieces, e.g., semiconductor wafers.

BACKGROUND

Mechanical and chemical-mechanical planarizing processes (collectively "CMP processes") remove material from the surface of semiconductor wafers, field emission displays, or other microelectronic workpieces in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a microelectronic workpiece 12 may be attached, or the microelectronic workpiece 12 may be attached to a resilient pad 34 in the head 32. The head 32 may be a free-floating wafer carrier, or an actuator assembly 36 may be coupled to the head 32 to impart axial and/or rotational motion to the workpiece 12 (indicated by arrows H and I, respectively).

The planarizing pad 40 and a planarizing solution 44 on the pad 40 collectively define a planarizing medium that mechanically and/or chemically removes material from the surface of the workpiece 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt, or other suitable materials. The planarizing solutions 44 used with the non-abrasive planarizing pads are typically abrasive slurries with abrasive particles suspended in a liquid. The planarizing solution may be replenished from a planarizing solution supply 46.

If chemical-mechanical planarization (as opposed to plain mechanical planarization) is employed, the planarizing solution 44 will typically chemically interact with the surface of the workpiece 12 to speed up or otherwise optimize the removal of material from the surface of the workpiece. Increasingly, microelectronic device circuitry (i.e., trenches, vias, and the like) is being formed from copper. When planarizing a copper layer using a CMP process, the planarizing solution 44 is typically neutral to acidic and includes an oxidizer (e.g., hydrogen peroxide) to oxidize the copper and increase the copper removal rate. One particular slurry useful for polishing a copper layer is disclosed in International Publication Number WO 02/18099, the entirety of which is incorporated herein by reference.

To planarize the workpiece 12 with the CMP machine 10, the carrier assembly 30 presses the workpiece 12 face-downward against the polishing medium. More specifically, the carrier assembly 30 generally presses the workpiece 12 against the planarizing solution 44 on a planarizing surface 42 of the planarizing pad 40, and the platen 20 and/or the carrier assembly 30 move to rub the workpiece 12 against the planarizing surface 42. As the workpiece 12 rubs against the planarizing surface 42, material is removed from the face of the workpiece 12.

CMP processes should consistently and accurately produce a uniformly planar surface on the workpiece to enable precise fabrication of circuits and photo-patterns. During the construction of transistors, contacts, interconnects and other features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to meet tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a workpiece.

In the highly competitive semiconductor industry, it is also desirable to maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components on the substrate (e.g., shallow trench isolation areas, contacts and damascene lines). Accurately stopping CMP processing at a desired endpoint is important for maintaining a high throughput because the substrate assembly may need to be re-polished if it is "under-planarized," or components on the substrate may be destroyed if it is "over-polished." Thus, it is highly desirable to stop CMP processing at the desired endpoint.

In one conventional method for determining the endpoint of CMP processing, the planarizing period of a particular substrate is determined using an estimated polishing rate based upon the polishing rate of identical substrates that were planarized under the same conditions. The estimated planarizing period for a particular substrate, however, may not be accurate because the polishing rate or other variables may change from one substrate to another. Thus, this method may not produce accurate results.

In another method for determining the endpoint of CMP processing, the substrate is removed from the pad and then a measuring device measures a change in thickness of the substrate. Removing the substrate from the pad, however, interrupts the planarizing process and may damage the substrate. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table. A polishing pad is attached to the table, and the pad has an aperture aligned with the window embedded in the table. The window is positioned at a location over which the workpiece can pass for in-situ viewing of a polishing surface of the workpiece from beneath the polishing table. The planarizing machine also includes a light source and a device for measuring a reflectance signal representative of an in-situ reflectance of the polishing surface of the workpiece. Lustig discloses terminating a planarizing cycle at the interface between two layers based on the different reflectances of the materials. In many CMP applications, however, the desired endpoint is not at an interface between layers of materials. In addition, the light source in Lustig must reflect from the surface of the workpiece, requiring that light pass through any polishing media between the window and the polishing surface twice. Any variations in the polishing media over time can change the absorption of the polishing media, introducing variability in the reflectance measurements. Thus, the system disclosed in Lustig may not provide accurate results in certain CMP applications.

Another optical endpointing system is a component of the MIRRA planarizing machine manufactured by Applied Materials Corporation of California. The MIRRA machine has a rotary platen with an optical emitter/sensor and a planarizing pad with a window over the optical emitter/sensor. The MIRRA machine has a light source that emits a single wavelength band of light and the sensor measures light reflected from the polishing surface of the workpiece. This machine can suffer from some of the same drawbacks associated with the system disclosed in Lustig.

DETAILED DESCRIPTION

Figure 1:
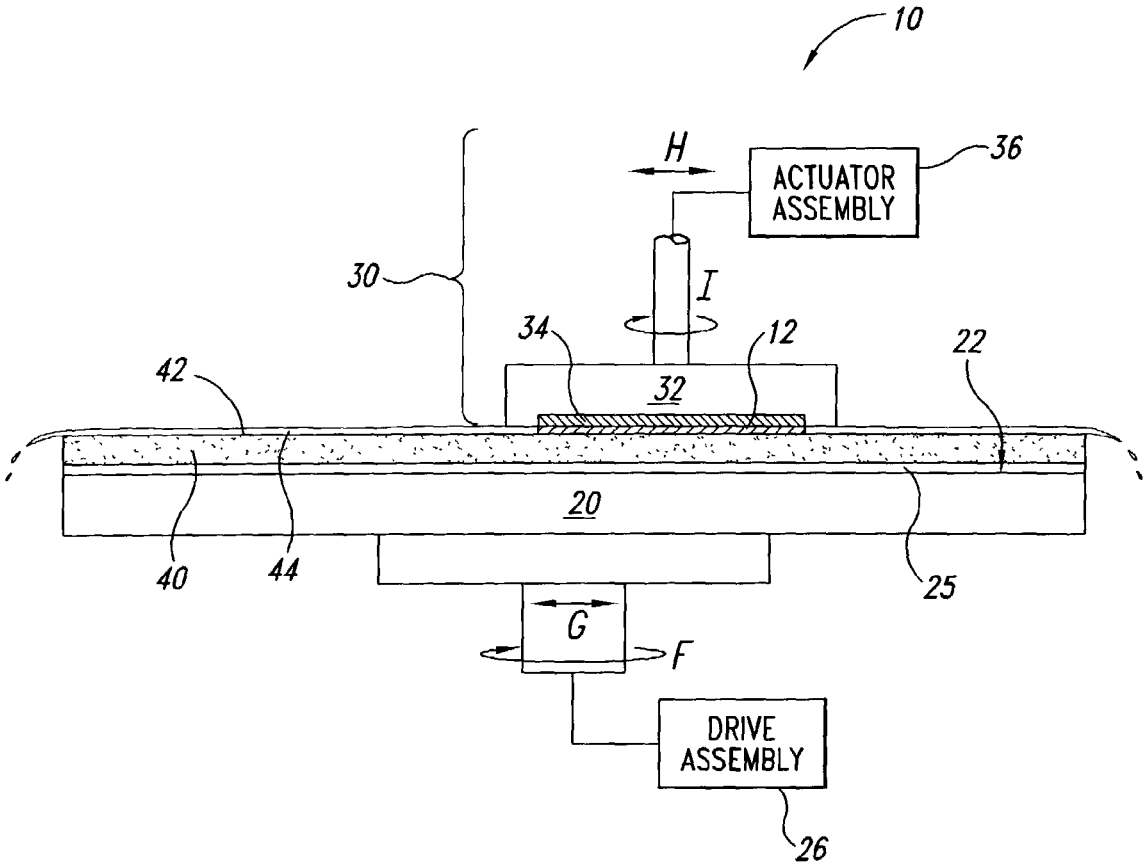
Fig. 1 (Prior Art)
FIG. 1 is a schematic cross-sectional view of a planarizing machine in accordance with the prior art.

Various embodiments of the present invention provide methods and apparatus for processing microelectronic workpieces. The terms "workpiece" and "workpiece assembly" may encompass a variety of articles of manufacture, including, e.g., semiconductor wafers, field emission displays, and other substrate-like structures either before or after forming components, interlevel dielectric layers, and other features and conductive elements of microelectronic devices. Many specific details of the invention are described below with reference to both rotary and web-format planarizing machines; the present invention can be practiced using other types of planarizing machines, too. The following description provides specific details of certain embodiments of the invention illustrated in the drawings to provide a thorough understanding of those embodiments. It should be recognized, however, that the present invention can be reflected in additional embodiments and the invention may be practiced without some of the details in the following description.

In one embodiment, the present invention provides a chemical-mechanical polishing system that includes a carrier assembly, a planarizing medium, and an optical monitor. The carrier assembly is adapted to hold a microelectronic workpiece. The planarizing medium comprises a planarizing solution and a planarizing pad. The planarizing medium is positioned to contact the microelectronic workpiece and includes an abrasive and a process indicator. The process indicator is adapted to change an optical property in response to a polishing condition. The optical monitor is adapted to monitor the planarizing medium to detect the change in the optical property of the process indicator. If so desired, the process indicator may be a thermally responsive and/or shear-responsive dye, or a combination of two or more thermally responsive and/or shear-responsive dyes.

Another embodiment of the invention provides a polishing medium that includes an abrasive and a process indicator. The process indicator is adapted to change an optical property in response to a polishing condition, permitting optical detection of the polishing condition.

Other embodiments of the invention provide a slurry for polishing a microelectronic workpiece. The slurry includes a fluid component and an abrasive suspended in the fluid component. In one application, the fluid component comprises a thermally responsive dye that is adapted to change color upon reaching a first temperature. In an alternative application, the fluid component comprises a shear-responsive dye adapted to change color in response to a first shear force.

Still other embodiments of the invention provide CMP polishing pads adapted to polish microelectronic workpieces. The polishing pads include a matrix adapted to support an abrasive and a dye in the matrix. The matrix may have a planar polishing surface. In one version of this embodiment, the dye comprises a thermally responsive dye that is adapted to change color in response to a first temperature. In other versions, the dye comprises a shear-responsive dye that is adapted to change color in response to a first shear force.

Other embodiments of the invention provide methods of polishing a microelectronic workpiece. In one such embodiment, a planarizing solution is delivered to a planarizing surface of a planarizing pad. The planarizing solution and the planarizing pad comprise a planarizing medium that includes an abrasive. The planarizing solution includes a process indicator adapted to change an optical property in response to a planarizing condition. The microelectronic workpiece is rubbed against the planarizing medium and the optical property of the process indicator is monitored to detect the change in the optical property.

Methods according to certain alternative embodiments also involve delivering a planarizing solution to a planarizing surface of a planarizing pad, with the planarizing solution and the planarizing pad comprising a planarizing medium that includes an abrasive. These methods also include rubbing the microelectronic workpiece against the planarizing medium. In one of these methods, the planarizing solution comprises a thermally responsive dye adapted to change color in response to a first temperature and rubbing the microelectronic workpiece against the planarizing medium is ceased in response to detecting the color change of the thermally responsive dye. In another one of these methods, the planarizing solution comprises a shear-responsive dye adapted to change color in response to a first shear force and rubbing the microelectronic workpiece against the planarizing medium is ceased in response to detecting the color change of the shear-responsive dye.

For ease of understanding, the following discussion is broken down into several areas of emphasis. The first section discusses various process indicators suitable for embodiments of the invention. The second section discusses apparatus in accordance with embodiments of the invention. The third section outlines methods in accordance with the invention.

Process Indicators

Workpieces are polished for a number of reasons in various stages of manufacture. In some operations, microelectronic workpieces with an irregular outer surface may be polished just long enough to smooth out the surface irregularities without removing a great deal of material. During the course of this operation, friction between the surface of the microelectronic workpiece and the planarizing medium of the CMP machine will increase as more of the workpiece's surface area comes into contact with the planarizing medium. This increased friction can increase the shear force on the planarizing medium and may elevate the temperature of the planarizing medium.

In other operations, substantially more of the surface of the microelectronic workpiece is removed. For example, in forming Shallow-Trench-Isolation (STI) structures, a substrate may include a number of trenches that are filled with a metal, a semiconductor, or other suitable material. The material used to fill the trenches is often applied across the entire surface of the substrate, leaving an overburden of material outside of the trenches. Once the overburden has been removed and the polishing medium begins to act on the substrate or any intermediate layer between the substrate and the overburden, the friction between the polishing medium and the workpiece may change. Again, the change in friction between the microelectronic workpiece and the polishing pad can change the shear force between the polishing medium and the workpiece and the temperature of the polishing medium can change.

In the preceding examples, the change in friction between the planarizing medium and the microelectronic workpiece is used to help determine when to stop the polishing process, conventionally known as "endpointing." It may also be desirable to monitor polishing conditions during the course of a planarizing cycle. For example, variations in the downforce of the workpiece against the polishing medium or the linear velocity of the workpiece with respect to the polishing medium can lead to undesirable variations in product quality. Being able to monitor these operating variations in real time could enhance quality control.

Certain embodiments of the present invention employ process indicators that change an optical property in response to a condition of the planarizing operation. In one embodiment, the process indicator is thermally responsive and will change an optical property, e.g., a change in a reflectance spectrum, in response to a change in temperature. In another embodiment, the process indicator is shear-responsive and will change an optical property, e.g., a change in a reflectance spectrum, in response to a change in shear force. Process indicators responsive to other polishing conditions, e.g., a compressive (as opposed to shear) force of the workpiece against the planarizing medium, may also be useful.

As explained in more detail below, the planarizing medium of a CMP machine will commonly include a planarizing pad and a planarizing solution. In accordance with different embodiments of the invention, the selected process indicator(s) may be incorporated in the planarizing pad, in the planarizing solution, or in both the planarizing pad and the planarizing solution. It may be desirable to include any shear-responsive process indicator(s) in the planarizing solution. Thermally responsive process indicators may work well as a component of the planarizing solution and/or the planarizing pad. Process indicators adapted to respond to compressive, as opposed to shear, forces may be well suited for inclusion in the planarizing pad.

A wide variety of thermally responsive, shear-responsive, and compression-responsive process indicators are known in the art and many such compositions are commercially available. In one embodiment, the process indicator comprises a thermally responsive fluid adapted to change a reflectance spectrum upon reaching a selected temperature. If this change in reflectance spectrum is in visible wavelengths of light, they may be detected as a change in color. The change may, instead, occur in non-visible wavelengths, e.g., in the infrared or the ultraviolet region. Known thermochromic dyes that exhibit such behavior include leuco dye compositions and thermochromic liquid crystals (including sterol-drived "cholosteric" chemicals, non-sterol based "chiral nematic" chemicals, and combinations of both cholosteric and chiral nematic components).

Leuco dyes are generally colorless or relatively light-colored, basic substances which may change color or otherwise change their optical properties when oxidized by acidic substances. Hence, conventional leuco dye-based thermochromic dyes will commonly include a suitable leuco dye; a source of labile hydrogen, such as a phenolic compound, an organic acid or metal salt thereof, or a hydroxybenzoic acid ester; an organic diluent such as an ester; water; and polyvinyl alcohol. (As used herein, the term "leuco dye" may refer to the leuco dye itself, e.g., 6'-(diethylamino)-3'-methyl-2'-(phenyl amino) spiro(isobenzofuran-1(3H),9'(9H) xanthen)-3-one, or to a thermochromic dye composition which includes a leuco dye.) Leuco dyes are commercially available from Color Change Corporation of Streamwood, Ill., U.S.A. Leuco dyes are also discussed in published International Application WO 01/04221 ("Thermochromic Ink Composition and Article Made Therefrom") and U.S. Pat. No. 6,165,937 ("Thermal Paper With a Near Infrared Radiation Scannable Data Image"), each of which is incorporated herein by reference in its entirety.

Thermochromic liquid crystals (TLCs) are commercially available from a variety of sources, including Hallcrest, Inc. of Glenview, Ill., U.S.A. TLCs will reflect different wavelengths of light over a range of temperatures. As used herein, the word "light" means radiation over the wavelength range of the infrared, visible and ultraviolet regions. At lower temperatures, conventional TLCs may reflect light primarily or exclusively in the infrared region and may visually appear generally clear or colorless. As the temperature increases to an intermediate temperature range, TLCs will reflect visible light. At yet higher temperatures, TLCs commonly move into the ultraviolet spectrum, again appearing essentially clear or colorless in the visible spectrum. At the lower end of the intermediate temperature range, TLCs will appear red. As the temperature increases within the intermediate temperature range, the visible color of the TLCs will pass through other colors of the visible spectrum, moving from orange to yellow to green to blue and then to violet at the upper end of the intermediate temperature range. Unlike leuco dyes, which typically will exhibit a single change in reflectance spectrum (either reversible or irreversible) at a specific temperature or narrow band of temperatures, the reflectance spectrum of a TLC can provide meaningful temperature feedback across a range of temperatures.

Another type of temperature-sensitive dye that may be included in a process indicator is a luminophor of the type employed in temperature sensitive paints (TSPs), often used in aerodynamic testing. Generally, such dyes are excited by absorbing light, typically in the long ultraviolet to blue range, and emit a red-shifted light. These luminophors are typically dispersed in a matrix of an insulator, e.g., a polyurethane. The intensity of the red-shifted light that is emitted by the luminophors generally decreases with increasing temperature. By correlating the measured intensity of the TSP to one or more known temperatures, the TSP can be used to detect a particular target temperature or give a quantitative indication of temperatures within a range of operating temperatures.

Suitable luminophors and insulators may be selected for any of a variety of different temperature ranges. One luminophor that exhibits suitable sensitivity in the range of about 25-250° F. is ruthenium tris(1,10-phenantholine)dichloride ("RU-phen"). Hubner et al. discuss the use of RU-phen in TSPs in "Heat Transfer Measurements in Hypersonic Flow Using Luminescent Coating Techniques," published in the proceedings of the American Institute of Aeronautics and Astronautic (AIAA) 40$^{th}$ Aerospace Sciences Meeting & Exhibit as paper no. AIAA 2002-0741, and techniques for using TSPs in aerodynamics applications are discussed by Hamner et al. in "Using Temperature Sensitive Paint Technology," published in the proceedings of the AIAA 40$^{th}$ Aerospace Sciences Meeting & Exhibit as paper no. AIAA 2002-0742, each of which is incorporated herein by reference in its entirety.

A variety of shear-sensitive materials useful as process indicators are known in the art. Shear-sensitive cholosteric liquid crystals, which are said to be relatively temperature-insensitive yet shear-sensitive, are commercially available from Hallcrest, Inc. of Glenview, Ill., U.S.A. Such shear-sensitive formulations are typically mixtures which show a single color transition or other reflectance change at a "clearing point;" if the shear is increased above the clearing point, the shear-sensitive liquid crystals may become clear or colorless. NASA has developed a technique for measuring magnitude and direction of shear force on a surface employing liquid crystals. In this technique, a white light source is directed at a liquid crystal coating and an angular shift in the reflected spectrum from the liquid crystal coating can be used to quantitatively determine the shear force. This technique is detailed in U.S. Pat. No. 5,438,879, issued to Reda ("Reda"), the entirety of which is incorporated herein by reference.

In another embodiment, a process indicator may comprise a compression-responsive material that will change optical properties in response to a planarizing condition. Luminophor-based pressure-sensitive coatings are well known in the art of aerodynamics and many of the same luminophors used in TSPs can also be used in such pressure-sensitive layers. U.S. Pat. No. 6,104,448, the entirety of which is incorporated herein by reference, suggests a liquid crystal-based compression-responsive indicator in which liquid crystals are compartmentalized in a series of separate cells, with application of sufficient mechanical force changing the crystals within the shell from a generally optically clear state to a more light-reflecting state.

The process indicator best suited for any particular CMP process will depend on the planarizing condition to be monitored. For example, if the process indicator is to be used in endpointing a CMP process, it may respond to a temperature or a pressure that may be correlated to the desired endpoint. As noted above, the desired endpoint may be associated with a change in friction between the workpiece and the planarizing pad, which can lead to a temperature change, typically a temperature increase. A leuco dye may be selected which changes from a specific reflectance spectrum to another (e.g., from a color to clear) at a temperature which can be correlated to the endpoint. This temperature may correspond precisely with the endpoint. Alternatively, the temperature may be achieved prior to the endpoint and polishing may continue for a specified period of time after the reflectance change is detected. As noted previously, TLCs may shift reflectance spectrum over a range of temperatures. In one embodiment, a TLC is selected in which anticipated operating temperatures or a temperature which is to be detected, e.g., a temperature which is correlated with a planarizing endpoint, falls within the intermediate temperature range at which the TLC has a visible color. If a TSP is employed, a luminophor that is stable and exhibits suitable sensitivity within the anticipated range of operating temperatures may be employed.

If the process indicator is a shear-sensitive liquid crystal that exhibits a single color change from a reflected color to a clear, colorless condition at a clearing point, the clearing point should be selected to correspond to a known planarizing condition, such as the shear stress which occurs at a planarizing endpoint or a specified point in time prior to the endpoint. If the process suggested by Reda is employed, liquid crystals should be selected which are stable and reflect the source light under the anticipated processing conditions.

If the process indicator is to be incorporated in the planarizing solution, care should be taken to select a process indicator that is stable in the planarizing solution. This process indicator may also be substantially non-reactive with the other components of the planarizing solution and/or the workpiece. It is anticipated that a relatively small volume of process indicator in the planarizing solution will suffice to generate a detectable optical change. For example, it is anticipated that a process indicator comprising no more than about 0.1 weight % of the planarizing solution will yield a detectable signal.

The process indicator, or a fraction thereof, may be incorporated in the polishing pad in a variety of different fashions. For example, the process indicator may comprise a plurality of discrete liquid volumes carried in a matrix of the planarizing pad. For example, the planarizing pad may comprise a resin matrix (e.g., a polyurethane resin) and an optically responsive dye, liquid crystal, or other suitable liquid may be included as a plurality of discrete liquid volumes within that matrix. The process indicator may be dispersed throughout the entire thickness of the polishing pad. In another embodiment, though, the process indicator is included only in an upper portion of the planarizing pad proximate the planarizing surface. Again, relatively small volumes of the process indicator within the planarizing pad may be sufficient to generate a readily detectable change in color or other optical property being detected. Process indicators comprising no more than about 0.1 weight % of the portion of the planarizing pad within which they are incorporated are expected to suffice.

In one embodiment, the process indicator comprises a single component, e.g., a single type of liquid crystal or luminophor or a single liquid dye composition. As noted above, both TLCs and luminophors typically vary optical properties across a range of temperatures. Utilizing a process indicator that comprises a single type of TLC or luminophor, therefore, can yield data over a range of temperatures. A process indicator comprising a single leuco dye composition will typically exhibit a single color change at a single temperature or narrow range of temperatures.

In other embodiments, a multiple-component process indicator is employed. Such a multiple-component process indicator may include a first component that is adapted to change an optical property in response to a first planarizing condition and a second component which is adapted to change an optical property in response to a second planarizing condition. The first and second planarizing conditions may be different, such that each of the components will generate an optically detectable change upon the occurrence of a different planarizing condition. The process indicator is not limited to two components, though; any suitable number of components may be employed to indicate a variety of different planarizing conditions. In particular, the multi-component process indicator may include three, four, or more different components and each of these components may be adapted to respond to a different planarizing condition.

In one embodiment, at least a first component and a second component of a multi-component process indicator are adapted to respond to the same type of planarizing condition. Hence, the first component may change an optical property upon reaching a first temperature and the second component may generate a visible change upon reaching a different second temperature. If the first and second components are both leuco dyes, for example, each of these components may exhibit a visible color change upon reaching a different activation temperature. The optical change exhibited by the first component may be different from the optical change exhibited by the second component. Using the same example, the two leuco dyes may have different colors to highlight that a dye's transition temperature has been reached. In one specific example, the first component comprises a blue leuco dye and the second component comprises a yellow leuco dye. At lower temperatures, the process indicator will be green (blue plus yellow); once the first leuco dye reaches its activation temperature and changes from blue to clear, the process indicator will change from green to yellow, the color of the second dye; the second dye may undergo its transition from colored to clear at a second, higher temperature, causing the process indicator to change from yellow to a clear condition. Even if the first and second components of the process indicator are adapted to respond to the same type of planarizing condition, there is no need for both of the components to be the same type of indicator. For example, the first component may comprise a leuco dye and the second component may comprise a liquid crystal, each of which changes optical property in response to a different temperature.

In an alternative embodiment, at least the first and second components of a multi-component process indicator are adapted to respond to different types of planarizing conditions. For example, the first process indicator may undergo an optical change in response to a change in temperature while the second component may exhibit its optical change in response to changes in the shear force. Other combinations of different types of planarizing conditions may also be employed.

As noted above, the process indicator may be included in virtually any suitable component of the planarizing system. For example, the process indicator or components thereof may be included in the planarizing solution, in the planarizing pad, or in both the planarizing solution and the planarizing pad. In another embodiment, the process indicator or at least one component thereof may be incorporated in the workpiece itself. This can be useful in reconditioning planarizing pads, for example, wherein the planarizing pad includes a process indicator and the planarizing medium for the reconditioning process (which will typically include a polishing solution and a reconditioning disk) may or may not include a second component of the process indicator. In one specific example, a thermally responsive liquid crystal or dye may be incorporated in the matrix of the planarizing pad and a shear-responsive liquid crystal may be included in the planarizing solution.

Apparatus

Figure 2:
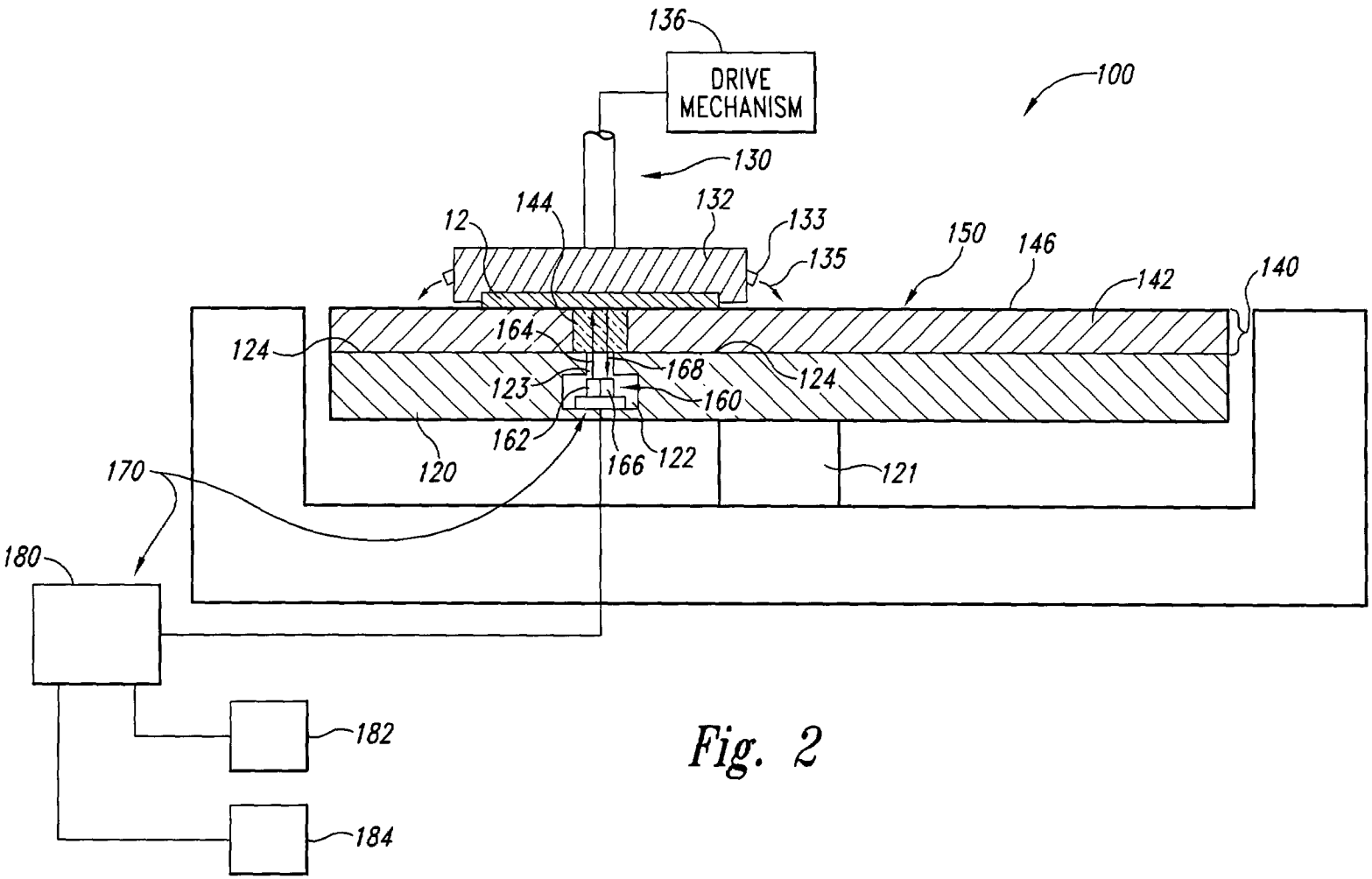
FIG. 2 is a schematic cross-sectional view of a rotary planarizing machine having a control system in accordance with an embodiment of the invention.

FIG. 2 is a cross-sectional view of a planarizing machine 100 in accordance with one embodiment of the invention. Several features of the planarizing machine 100 are shown schematically. The planarizing machine 100 of this embodiment includes a table or platen 120 coupled to a drive mechanism 121 that rotates the platen 120. The platen 120 can include a cavity 122 having an opening 123 at a support surface 124. The planarizing machine 100 can also include a carrier assembly 130 having a workpiece holder 132 or head coupled to a drive mechanism 136. The workpiece holder 132 holds and controls a workpiece 12 during a planarizing cycle. The workpiece holder 132 can include a plurality of nozzles 133 through which a planarizing solution 135 can flow during a planarizing cycle. The carrier assembly 130 can be substantially the same as the carrier assembly 30 described above with reference to FIG. 1.

The planarizing machine 100 can also include a planarizing medium 150 comprising a planarizing solution 135 and a planarizing pad 140 having a planarizing body 142 and an optically transmissive window 144. The planarizing body 142 can be form of an abrasive or non-abrasive material having a planarizing surface 146. For example, an abrasive planarizing body 142 can have a resin matrix (e.g., a polyurethane resin) and a plurality of abrasive particles fixedly attached to the resin matrix. Suitable abrasive planarizing bodies 142 are disclosed in U.S. Pat. Nos. 5,645,471, 5,879,222, 5,624,303, 6,039,633, and 6,139,402, each of which is incorporated herein in its entirety by reference.

Figure 3:
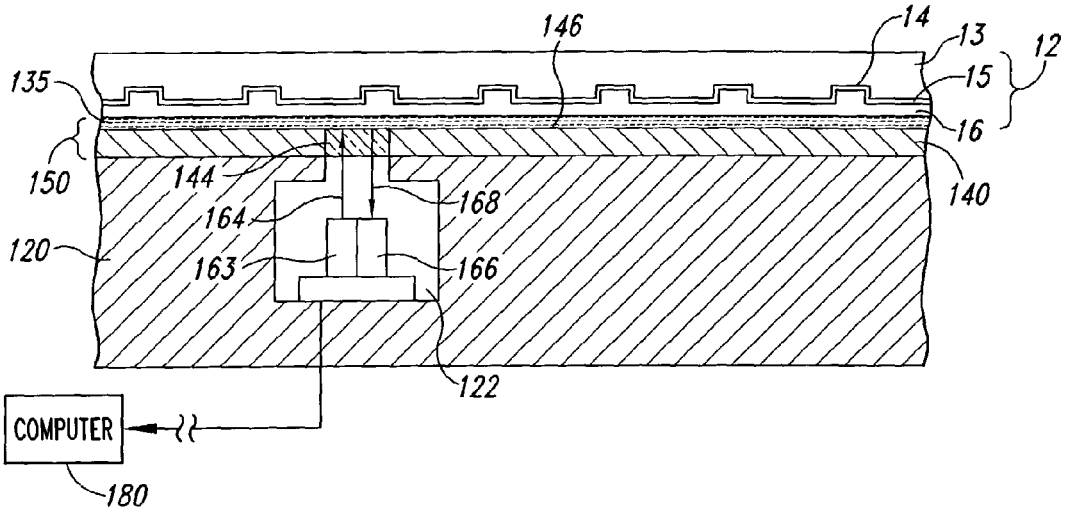
FIG. 3 is a schematic, partial cross-sectional view of the planarizing machine of FIG. 2 illustrating a partially planarized microelectronic substrate.

The optically transmissive window 144 can be an insert in the planarizing body 142. Suitable materials for the optically transmissive window include polyester (e.g., optically transmissive MYLAR); polycarbonate (e.g., LEXAN); fluoropolymers (e.g., TEFLON); glass; or other optically transmissive materials that are also suitable for contacting a surface of a microelectronic workpiece 12 during a planarizing cycle. A suitable planarizing pad having an optically transmissive window is disclosed in U.S. patent application Ser. No. 09/595,797, which is herein incorporated in its entirety by reference. In certain embodiments, the optically transmissive window 144 either extends through the entire thickness of the planarizing body 142, as illustrated in FIGS. 2 and 3, or a transmissive window 144 having a thickness less than the thickness of the planarizing body 142 can be inserted in a hole which passes through the entire thickness of the planarizing body 142.

In another embodiment, a portion of the planarizing body 142 extends over an upper surface of the transmissive window 144, separating the transmissive window from contact with the workpiece. This presents a continuous, consistent planarizing surface 146, which can enhance product quality. In one particular adaptation of this embodiment, at least one component of the process indicator is included in the portion of the planarizing body that extends over an upper surface of the window. This enables the optical change in the process indicator to be detected through the window 144. It is anticipated that covering an upper surface of the window 144 would be counterproductive in a more conventional CMP machine, such as that suggested by Lustig.

The planarizing machine 100 also includes a control system 170 having a light system 160 and a computer 180. The light system 160 can include a light source 162 that generates a beam of light 164 and a sensor 166 having a photodetector to receive reflected light 168. In this embodiment, the light source 162 is configured to direct the light beam 164 upwardly through the window 144 to impinge the planarizing medium 150 during a planarizing cycle. The light source 162 can generate a series of light pulses over time or can constantly illuminate the planarizing medium. The sensor 166 is configured to receive the reflected or emitted light 168 that reflects from the planarizing medium 150 or, if the process indicator comprises a luminophor, that is emitted by the planarizing medium 150.

The nature of the light source 162 can be varied to enhance sensitivity to the optical change or changes exhibited by the selected process indicator. As noted above, many process indicators contemplated for use in the CMP machine 100 will exhibit a change in reflectance and/or absorption in the visible spectrum, generating a visible color change. In such a circumstance, the light source 162 may comprise a wide-spectrum white light source and the sensor 166 may comprise a CCD of the type commonly included in a digital camera or the like. Using a conventional light source and digital camera can reduce the costs of manufacturing and maintaining the CMP machine 100. In another embodiment, the light source 162 may comprise one or more light sources, each adapted to generate a single wavelength of light (e.g., a laser) or light having a relatively narrow wavelength range (e.g., an LED), which will generate light in a wavelength affected by the optical change in the process indicator. If the process indicator changes optical properties over a range of planarizing conditions, e.g., a liquid crystal which changes color across a range of temperatures, selecting a light source having a single wavelength or narrow band of wavelengths can facilitate detection of when the process indicator reaches a predetermined reflectance at the measured wavelength(s) that is associated with the desired planarizing condition.

The computer 180 is coupled to the light system 160 to activate the light source 162 and/or to receive a signal from the sensor 166 corresponding to the intensity and/or color of the reflected light 168. The computer 180 has a database 182 containing a plurality of reference reflectances corresponding to the status of the planarizing medium. The computer 180 also contains a computer-readable program 184 that causes the computer 180 to control a parameter of the planarizing machine 100 when the measured property or properties of the reflected light 168 corresponds to a selected reference property (e.g., reflected color) in the database 182.

The computer program 184 can be contained on a computer-readable medium stored in the computer 180. In one embodiment, the computer-readable program 184 causes the computer 180 to control a parameter of the planarizing machine 100 when the measured property of the reflected light 168 is approximately the same as the reference property stored in the database 182 corresponding to a known polishing condition. The computer 180, therefore, can indicate that the planarizing cycle is at an endpoint, the workpiece has become planar, the polishing rate has changed, the downforce is outside of acceptable limits and/or control another aspect of planarizing of the microelectronic workpiece 12.

The computer program 184 can accordingly cause the computer 180 to control a parameter of the planarizing cycle according to the correspondence between the measured color or other optical property of the planarizing medium and the reference property stored in the database 182. In one embodiment, the computer program 184 can cause the computer 180 to adjust an operating parameter of the planarizing cycle, such as the downforce, flow rate of the planarizing solution, and/or relative velocity according to the measured reflectance spectrum of the polishing medium. In another embodiment, the computer program 184 can cause the computer 180 to terminate the planarizing cycle once the measured reflectance spectrum of the reflected light 168, for example, corresponds to the reflectance spectrum (e.g., color) in the database 182 associated with the endpoint of the workpiece 12.

The computer 180 can be one type of controller for controlling the planarizing cycle using the control system 150. The controller can alternatively be an analog system having analog circuitry and a set point corresponding to reference reflectances of a specific planarizing condition.

FIG. 3 is a partial schematic cross-sectional view of a stage of a planarizing cycle that uses the planarizing machine 100 to form Shallow-Trench-Isolation (STI) structures in one embodiment of a method of the invention. In the illustrated embodiment, the workpiece 12 has a substrate 13 with a plurality of trenches 14, a barrier layer 15 (e.g., silicon nitride or tantalum nitride) deposited on the substrate 13, and a metal layer 16 (e.g., copper or aluminum) deposited on the barrier layer 15. FIG. 3 shows the workpiece 12 at a stage of the planarizing cycle in which the metal layer 16 has been partially planarized.

Figure 4:
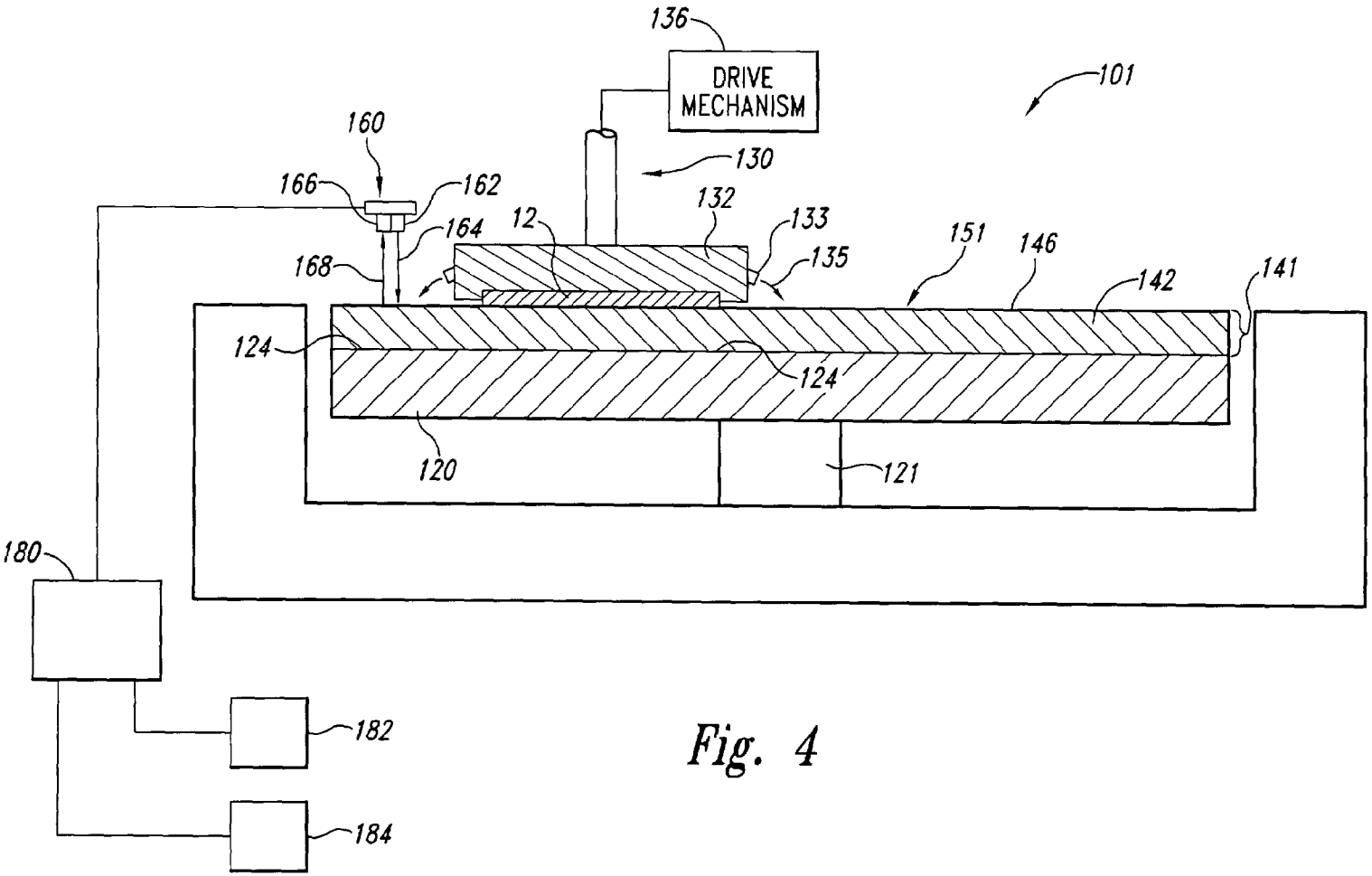
FIG. 4 is a schematic cross-sectional view of a rotary planarizing machine having a control system in accordance with an alternative embodiment of the invention.

FIG. 4 schematically illustrates a rotary planarizing machine 101 in accordance with an alternative embodiment of the invention. Many aspects of the planarizing machine 101 in FIG. 4 are similar to aspects of the planarizing machine 100 of FIG. 2; in these two drawings, the same reference numbers identify elements with the same or similar functionality for ease of understanding.

One difference between the planarizing machine 101 in FIG. 4 and the planarizing machine 100 in FIG. 2 is the location where the light beam 164 impinges on the planarizing medium (151 in FIG. 4 or 150 in FIG. 2). As noted above, the planarizing machine 100 of FIG. 2 includes a light system 160 positioned beneath the window 144 to impinge on the planarizing medium 150. In the planarizing machine 101 of FIG. 4, though, the light system 160 is adapted to direct the beam of light 164 toward the planarizing surface 146 of the planarizing pad 141. In the illustrated embodiment, the light source 162 is positioned higher than the planarizing pad 141 and directs the light beam 164 generally downwardly toward the planarizing medium 151. In one embodiment, the light beam 164 is generally perpendicular to the plane of the planarizing surface 146 and the light sensor 166 may be positioned adjacent the light source 162. Because the light system 160 is not constrained to a relatively small cavity 122 in the platen 120, though, the light beam 164 in another embodiment is directed at an oblique angle to the plane of the planarizing surface 146 and the light sensor 166 may be spaced from the light source 162. This embodiment may facilitate measurement of shear force in the planarizing solution 135 as proposed by Reda and discussed above.

In most conventional planarizing machines, a workpiece holder 132 covers part or all of an upper surface of the workpiece 12. In the illustrated embodiment, therefore, the light beam 164 is adapted to direct light against the planarizing medium 151 at a location displaced from the workpiece 12. The location where the light beam 164 impinges the planarizing medium 151 should be selected to ensure that the optical properties of the planarizing medium 151 at that location reliably correlate to the planarizing condition being measured. In one embodiment, the light system 160 is mounted on the workpiece holder 132 to travel with the workpiece 12 as it moves with respect to the planarizing medium 151.

In the embodiment of FIG. 4, the planarizing pad 141 does not include a transmissive window (144 in FIG. 2). In an alternative embodiment, the planarizing pad 141 does include such a transmissive window and the light source may comprise a first light source 160 directed to impinge the planarizing medium 151 from above at a location displaced from the workpiece 12 and a second light system (not shown in FIG. 4) positioned in a cavity (122 in FIGS. 2 and 3) in the platen 120 directed to impinge the planarizing medium from below.

Figure 5:
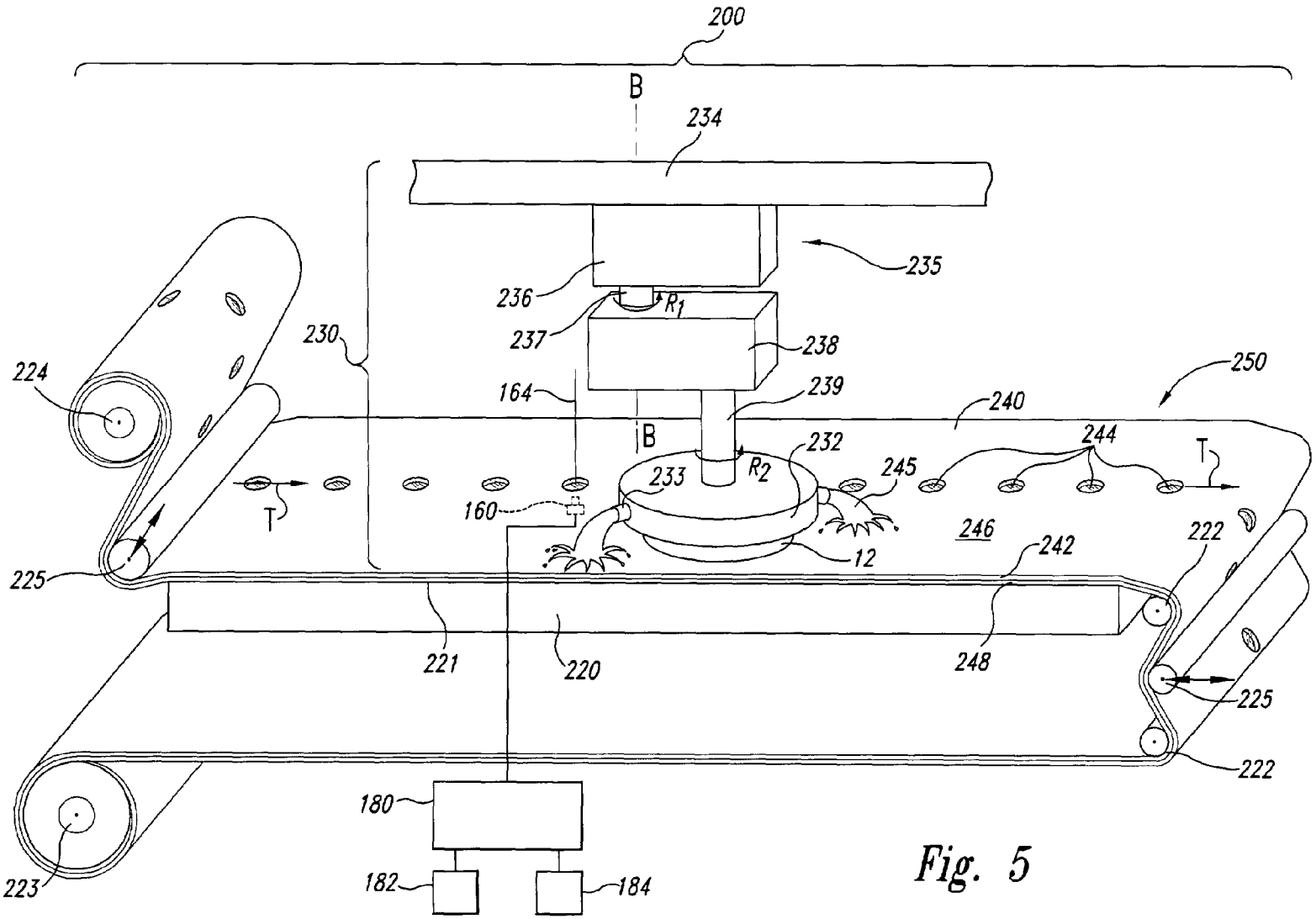
FIG. 5 is a schematic isometric view of a web-format planarizing machine in accordance with a different embodiment of the invention.

FIG. 5 is a schematic isometric view of a web-format planarizing machine 200 in accordance with another embodiment of invention. The planarizing machine 200 has a support table 220 having a top panel 221 at a workstation where an operative portion of a web-format planarizing pad 240 is positioned. The top panel 221 is generally a rigid plate, and it provides a flat, solid surface to which a particular section of a web-format planarizing pad 240 may be secured during planarization.

The planarization machine 200 also has a plurality of rollers to guide, position, and hold the planarizing pad 240 over the top panel 221. The rollers can include a supply roller 224, idler rollers 225, guide rollers 222, and a take-up roller 223. The supply roller 224 carries an unused or pre-operative portion of the planarizing pad 240, and the take-up roller 223 carries a used or post-operative portion of the planarizing pad 240. Additionally, the left idler roller 225 and the upper guide roller 222 stretch the planarizing pad 240 over the top panel 221 to couple the planarizing pad 240 to the table 220. A motor (not shown) generally drives the take-up roller 223 to sequentially advance the planarizing pad 240 across the top panel 221 along a pad travel path T-T, and the motor can also drive the supply roller 224. Accordingly, a clean pre-operative section of the planarizing pad 240 may be quickly substituted for a used section to provide a consistent surface for planarizing and/or cleaning the workpiece 12.

The web-format planarizing machine 200 also includes a carrier assembly 230 that controls and protects the workpiece 12 during planarization. The carrier assembly 230 generally has a workpiece holder 232 to pick up, hold, and release the workpiece 12 at appropriate stages of a planarizing cycle. A plurality of nozzles 233 projects from the workpiece holder 232 to dispense a planarizing solution 245 onto the planarizing pad 240. This planarizing solution 245 and the planarizing pad 240 may together comprise a planarizing medium 250. The carrier assembly 230 also generally has a support gantry 234 carrying a drive assembly 235 that can translate along the gantry 234. The drive assembly 235 generally has an actuator 236, a drive shaft 237 coupled to the actuator 236, and an arm 238 projecting from the drive shaft 237. The arm 238 carries a workpiece holder 232 via a terminal shaft 239 such that the drive assembly 235 orbits substrate holder 232 about an axis B-B (arrow $R_1$). The terminal shaft 239 may also be coupled to the actuator 236 to rotate the workpiece holder 232 about its central axis (arrow $R_2$).

The planarizing pad 240 shown in FIG. 5 can include a planarizing body 242 having a plurality of optically transmissive windows 244 arranged in a line generally parallel to the pad travel path T-T As noted above, these windows 244 may extend through only a portion of the planarizing body, with a thickness of the planarizing body extending over the top of the window 244. The planarizing pad 240 can also include an optically transmissive backing film 248 under the planarizing body 242. Suitable planarizing pads for web-format machines are disclosed in, for example, U.S. Pat. No. 6,213,845, the entirety of which is incorporated herein by reference.

The planarizing machine 200 can also include a control system having the light system 160 and the computer 180 described above with reference to FIGS. 2-3. In operation, the carrier assembly 230 preferably lowers the workpiece 12 against the planarizing medium 250 and orbits the substrate holder 232 about the axis B-B to rub the workpiece 12 against the planarizing medium 250. The light system 160 emits the source light 164, which passes through a window 244 aligned with an illumination site on the table 220 to optically monitor the status of the planarizing medium 250 during the planarizing cycle, as discussed above with reference to FIGS. 2-3. The web-format planarizing machine 200 with the light system 160 and the computer 180 is thus expected to provide many of the same advantages as the planarizing machine 100 described above. Systems for enhancing alignment of the light system 160 with the window 244 are discussed in co-pending U.S. patent application Ser. No. 09/651,240, filed 30 Aug. 2000, the entirety of which is incorporated herein by reference.

Figure 6:
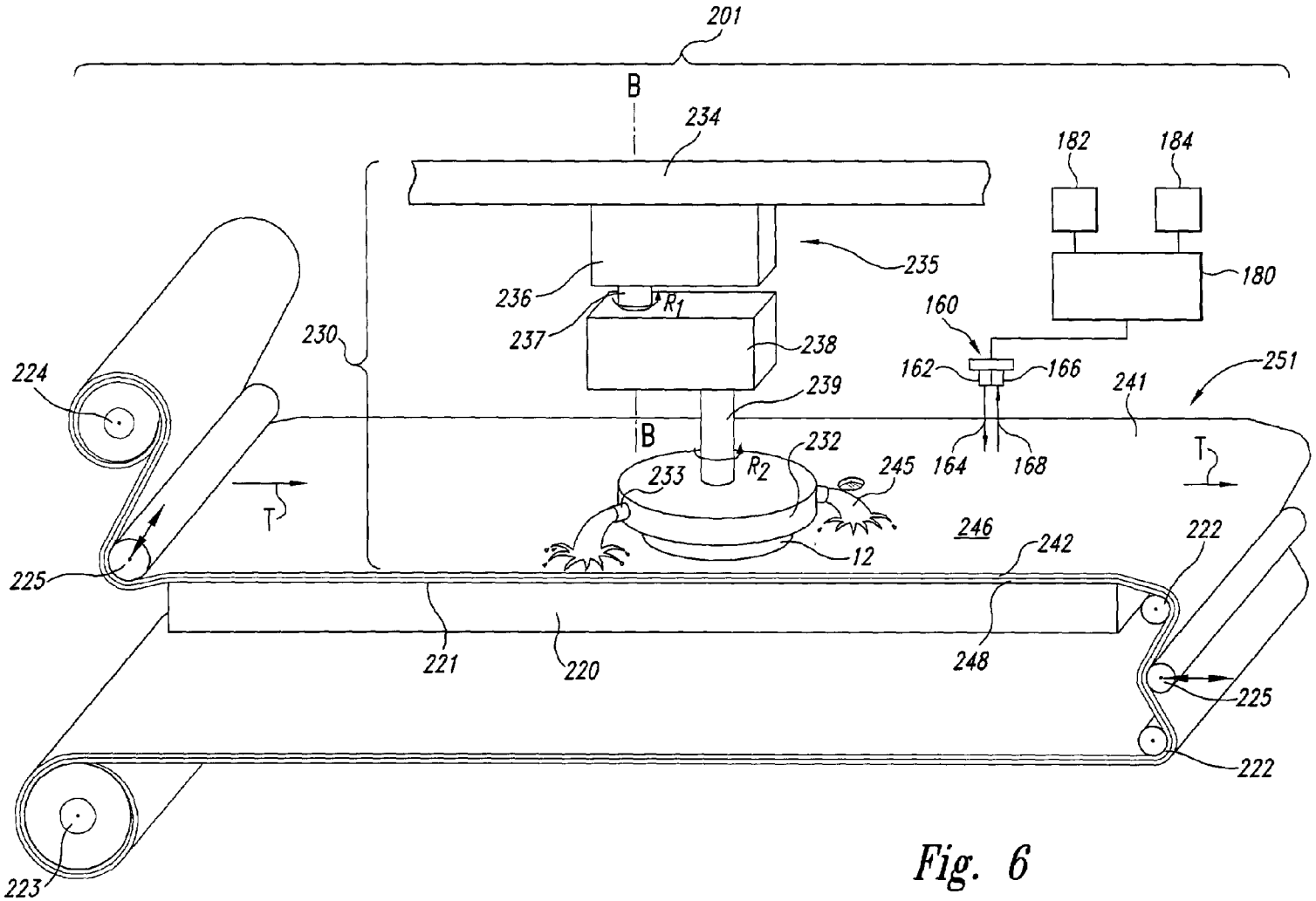
FIG. 6 is a schematic isometric view of a web-format planarizing machine in accordance with another embodiment of the invention.

FIG. 6 is a schematic isometric view of a web-format planarizing machine 201 in accordance with an alternative embodiment of the invention. The web-format planarizing machine 201 in FIG. 6 includes a number of the same elements as the planarizing machine 200 of FIG. 5 and the same reference numerals are used in both drawings to indicate like elements.

One difference between the planarizing machine 201 of FIG. 6 and the planarizing machine 200 of FIG. 5 is that the light system 160 is positioned at a height above the planarizing surface 246 of the planarizing medium 251 rather than striking the planarizing medium through a window (244 in FIG. 5) in the planarizing pad 240. As with the embodiment of FIG. 4, omitting the window in the planarizing pad 241 can improve homogeneity of the planarizing surface 246, enhancing product consistency. As also noted above in connection with FIG. 4, the light system 160 in FIG. 6 may be mounted on the workpiece carrier 232, allowing the light system 160 to impinge the planarizing medium 251 at a location displaced a known distance from the workpiece 12.

Methods

As noted previously, some embodiments of the invention provide methods for planarizing a workpiece. For ease of understanding, the following discussion makes reference to the planarizing machine 100 of FIGS. 2 and 3 and its components to illustrate aspects of these methods. It should be understood, though, that methods of the invention are not limited to being carried out on this machine 100, but may be performed on any suitable apparatus, including, but not limited to, the rotary planarizing machine 101 of FIG. 4 and the web-format planarizing machines 200 and 201 of FIGS. 5 and 6.

One embodiment provides a method in which a planarizing solution 135 is delivered to the planarizing surface 146 of a planarizing pad 140. The workpiece 12 is rubbed against the planarizing medium 150. The planarizing medium 150 includes a process indicator, which may be incorporated in the planarizing solution (as best seen in FIG. 3), in the planarizing pad 140, or in both the planarizing solution 135 and the planarizing pad 140. The process indicator is optically monitored to detect a change in the optical property.

This change in optical property, as noted above, may be in response to reaching a particular temperature, in response to a particular shear force or compressive force, or any other suitable process indicator.

Upon detecting the change in the optical property of the process indicator, an operating parameter of the planarizing machine 100 may be changed. For example, when a particular change in optical property of the process indicator is associated with an endpoint, rubbing of the workpiece 12 against the planarizing medium 150 may be ceased. This may occur immediately or planarizing can continue for a specified time after the optical change is detected.

In another embodiment, the operating parameter that is changed does not involve ceasing rubbing the workpiece 12 against the planarizing medium 150. The planarizing machine 100 will operate according to a number of different operating parameters, such as the downforce of the workpiece 12 against the planarizing medium 150, a flow rate of the planarizing solution 135 onto the planarizing pad 140, the relative velocity of the workpiece 12 with respect to the planarizing medium 150, etc. For example, if the downforce is too high, the temperature of at least portions of the planarizing medium 150 may exceed the temperature at which the color of a TLC in the planarizing medium reaches a predetermined threshold color. Upon detecting this threshold color in the process indicator, the computer program 184 can cause the computer 180 to reduce the downforce, bringing the planarizing operation within the predetermined specifications.

Another embodiment of the invention provides a method for conditioning a used CMP planarizing pad. Over time, a planarizing pad can become worn. To keep the planarizing pad within acceptable tolerances, the pad may be conditioned from time to time by planarizing the polishing pad, removing a portion of the planarizing pad. This process may be repeated a number of times during the useful life of the planarizing pad.

In accordance with this embodiment, the used CMP planarizing pad is positioned proximate a planarizing medium. The planarizing medium may, for example, comprise a planarizing solution and a diamond CMP conditioning disk of the type commercially available from, for example, Abrasive Technology of Lewis Center, Ohio, USA. The used CMP planarizing pad may be of the type outlined above wherein the planarizing pad incorporates the process indicator, e.g., by dispersing a TLC or leuco dye within the matrix of at least a portion of the polishing pad. In one embodiment, the process indicator will change its optical property in response to a change in temperature of or a change in the force on the used planarizing pad. The used CMP planarizing pad may be rubbed against the conditioning planarizing medium under a set of operating parameters, including a predefined downforce, flow rate of planarizing solution, and relative velocity. At least one of these operating parameters may be changed in response to detecting a change in the optical property of the process indicator. This change in the operating parameter may, for example, comprise changing the downforce of the used CMP polishing pad against the polishing medium or terminating the planarization cycle.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. The above detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform steps in a different order. Aspects of the invention may also be useful in other applications, e.g., in polishing workpieces other than microelectronic workpieces. The various embodiments described herein can be combined to provide further embodiments.

In general, the terms used in the following claims should not be construed to limit the invention to the specific embodiments disclosed in the specification, unless the above detailed description explicitly defines such terms. While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. A chemical-mechanical planarizing system comprising:

a carrier assembly adapted to hold a microelectronic workpiece;

a planarizing medium comprising a planarizing solution and a planarizing pad, the planarizing medium being positioned to contact the microelectronic workpiece and including an abrasive and a process indicator adapted to change an optical property in response to at least one planarizing condition selected from a group consisting of temperature, shear force, and compression force; and an optical monitor adapted to monitor the planarizing medium to detect the change in the optical property of the process indicator; and wherein the process indicator comprises a first fluid component and a second fluid component, the first fluid component being adapted to generate a visible change upon reaching a first temperature and the second fluid component being adapted to generate a visible change upon reaching a different second temperature.

2. The chemical-mechanical planarizing system of claim 1 wherein the process indicator is incorporated in the planarizing pad.

3. The chemical-mechanical planarizing system of claim 2 wherein the process indicator comprises a plurality of discrete liquid volumes carried in a matrix of the planarizing pad.

4. The chemical-mechanical planarizing system of claim 1 wherein the process indicator comprises a fluid component of the planarizing solution.

5. The chemical-mechanical planarizing system of claim 4 wherein the fluid is adapted to change the optical property upon reaching a first temperature.

6. The chemical-mechanical planarizing system of claim 4 wherein the fluid is adapted to change the optical property in response to a first shear force.

7. The chemical-mechanical planarizing system of claim 1 wherein the process indicator comprises a dye.

8. The chemical-mechanical planarizing system of claim 7 wherein the dye is microencapsulated.

9. The chemical-mechanical planarizing system of claim 1 wherein the process indicator is selected from a group consisting of leuco dyes, thermochromic liquid crystals, shear-sensitive liquid crystals, and luminophors.

10. The chemical-mechanical planarizing system of claim 1 wherein the process indicator comprises a liquid crystal or a dye and the planarizing condition comprises a first temperature, the liquid crystal or dye being adapted to generate a visible change upon reaching the first temperature.

11. The chemical-mechanical planarizing system of claim 10 wherein the process indicator further comprises a second liquid crystal or dye adapted to generate a visible change in response to a first shear force.

12. The chemical-mechanical planarizing system of claim 1 wherein the process indicator comprises a liquid crystal or a dye and the planarizing condition comprises a first shear force, the liquid crystal or dye being adapted to generate a visible change in response to the first shear force.

13. The chemical-mechanical planarizing system of claim 12 wherein the process indicator further comprises a second liquid crystal or dye adapted to generate a visible change upon reaching a first temperature.

14. The chemical-mechanical planarizing system of claim 1 wherein the abrasive is included in the planarizing solution and the planarizing solution further comprises a fluid component, the process indicator comprising a fraction of the fluid component.

15. The chemical-mechanical planarizing system of claim 14 wherein the process indicator comprises no more than about 0.1 weight % of the planarizing solution.

16. The chemical-mechanical planarizing system of claim 1 wherein the optical monitor comprises a light source oriented toward the planarizing medium and a sensor adapted to detect light reflected or emitted by the planarizing medium.

17. The chemical-mechanical planarizing system of claim 1 wherein the optical monitor comprises a visible light source oriented toward the planarizing medium and a light sensor adapted to detect visible light reflected by the planarizing medium.

18. The chemical-mechanical planarizing system of claim 17 wherein the light sensor comprises a CCD.

19. The chemical-mechanical planarizing system of claim 1 wherein the optical monitor comprises a light source and a light sensor, the light source being positioned higher than the planarizing pad and adapted to direct light against the planarizing medium at a location displaced from the workpiece, the light sensor being adapted to detect light reflected or emitted by the planarizing medium.

20. A planarizing medium, comprising:

an abrasive; and a process indicator included in a fluid planarization solution, the process indicator being adapted to change an optical property in response to a planarizing condition, permitting optical detection of the planarizing condition;

wherein the process indicator is a first process indicator, the optical property is a first optical property, and the planarizing condition is a first planarizing condition, and wherein the planarizing pad includes a second process indicator that comprises a plurality of discrete liquid volumes carried in a matrix of the planarizing pad and that is adapted to change a second optical property in response to a second planarizing condition.

21. The planarizing medium of claim 20 wherein the planarizing medium further comprises a planarizing pad.

22. The planarizing medium of claim 20 wherein the process indicator comprises a fluid.

23. The planarizing medium of claim 22 wherein the fluid is adapted to change the optical property upon reaching a first temperature.

24. The planarizing medium of claim 22 wherein the fluid is adapted to change the optical property in response to a first shear force.

25. The planarizing medium of claim 20 wherein the process indicator comprises a dye.

26. The planarizing medium of claim 25 wherein the dye is microencapsulated.

27. The planarizing medium of claim 20 wherein the process indicator is selected from a group consisting of leuco dyes, thermochromic liquid crystals, shear-sensitive liquid crystals, and luminophors.

28. The planarizing medium of claim 20 wherein the process indicator comprises a liquid crystal or dye and the planarizing condition comprises a first temperature, the liquid crystal or dye being adapted to generate a visible change upon reaching the first temperature.

29. The planarizing medium of claim 28 wherein the process indicator further comprises a second liquid crystal or dye adapted to generate a visible change in response to a first shear force.

30. The planarizing medium of claim 20 wherein the process indicator comprises a liquid crystal or dye and the planarizing condition comprises a first shear force, the liquid crystal or dye being adapted to generate a visible change in response to the first shear force.

31. The planarizing medium of claim 30 wherein the process indicator further comprises a second liquid crystal or dye adapted to generate a visible change upon reaching a first temperature.

32. The planarizing medium of claim 20 wherein the process indicator comprises a first fluid component and a second fluid component, the first fluid component being adapted to generate a visible change upon reaching a first temperature and the second fluid component being adapted to generate a visible change upon reaching a different second temperature.

33. The planarizing medium of claim 20 wherein the abrasive is included in the planarizing solution and the planarizing solution further comprises a fluid component, the process indicator comprising a fraction of the fluid component.

34. The planarizing medium of claim 20 wherein the process indicator comprises no more than about 0.1 weight % of the planarizing solution.

* * * * *